US009316966B2

(12) United States Patent
Kondo

(10) Patent No.: US 9,316,966 B2
(45) Date of Patent: Apr. 19, 2016

(54) FIXING DEVICE AND IMAGE FORMING APPARATUS INCLUDING THE SAME

(71) Applicant: KYOCERA Document Solutions Inc., Osaka-shi, Osaka (JP)

(72) Inventor: Akihiro Kondo, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/751,582

(22) Filed: Jun. 26, 2015

(65) Prior Publication Data

US 2016/0004194 A1 Jan. 7, 2016

(30) Foreign Application Priority Data

Jul. 3, 2014 (JP) ..... 2014-137619

(51) Int. Cl.
*G03G 15/20* (2006.01)

(52) U.S. Cl.
CPC ..... *G03G 15/2028* (2013.01); *G03G 15/2067* (2013.01); *G03G 15/2085* (2013.01)

(58) Field of Classification Search
CPC ..... G03G 15/2032; G03G 15/2053; G03G 15/2067; G03G 15/2085; G03G 2215/00417
See application file for complete search history.

(56) References Cited

U.S. PATENT DOCUMENTS 5,179,415 A * 1/1993 Ikematsu ..... G03G 15/2035 219/216
5,926,680 A * 7/1999 Yamamoto ..... G03G 15/2053 399/328
5,956,554 A * 9/1999 Yanashima ..... G03G 15/2064 399/328
6,282,398 B1 * 8/2001 Higashi ..... G03G 15/2064 219/216
6,580,894 B1 * 6/2003 Kobashigawa .... G03G 15/2064 219/216
9,229,382 B2 * 1/2016 Kondo ..... G03G 15/2028
2011/0026944 A1 * 2/2011 Naitoh ..... G03G 15/2085 399/21
2013/0004213 A1 * 1/2013 Takahashi ..... G03G 15/2028 399/323

FOREIGN PATENT DOCUMENTS

JP 09237004 A 9/1997
JP 2005258041 A * 9/2005

* cited by examiner

*Primary Examiner* — David Gray
*Assistant Examiner* — Carla Therrien
(74) *Attorney, Agent, or Firm* — Alleman Hall McCoy Russell & Tuttle LLP

(57) ABSTRACT

A fixing device including: arms that support the heating roller and the pressure roller so as to be displaced between a pressure-contact attitude in which a nip portion is formed and a distanced attitude in which the nip portion is released; a solenoid that displaces the rollers to the distanced attitude; a separation plate that has an electric conductivity, is disposed to face the heating roller, and separates the sheet that has passed through the nip portion from the heating roller; and interlocking arms that, in interlock with displacement from the pressure-contact attitude to the distanced attitude by the solenoid, displace a first end portion of the separation plate to an attitude to be distanced away from the heating roller by a first distance, change the potential of the separation plate from a floating potential to a reference potential, and accelerate discharge between the heating roller and the separation plate.

8 Claims, 7 Drawing Sheets

FIXING DEVICE AND IMAGE FORMING APPARATUS INCLUDING THE SAME

INCORPORATION BY REFERENCE

This application is based upon and claims the benefit of priority from the corresponding Japanese Patent Application No. 2014-137619 filed on Jul. 3, 2014, the entire contents of which are incorporated herein by reference.

BACKGROUND

The present disclosure relates to a fixing device including a separation member for separating a sheet that has stuck to a rotator such as a fixing rotator, and to an image forming apparatus including the fixing device.

An image forming apparatus such as a printer, a facsimile or a copier includes a fixing device that applies heat and pressure to a sheet with toner thereon so that the toner is fixed to the sheet. The fixing device includes a fixing rotator and a pressure rotator, wherein the fixing rotator transmits the heat to the sheet, and the pressure rotator is made pressure-contact with the fixing rotator, and a nip portion is formed when the rotators make pressure-contact with each other. When the sheet passes through the nip portion, a toner image carried on the sheet is fused and fixed to the sheet. The sheet to which the toner image has been fixed is conveyed from the nip portion to the discharge tray. At this time, the sheet may be stuck to the surface of the fixing rotator due to the adhesive force of the fused toner, resulting in a conveyance error and occurrence of a paper jam. As a result, a separation member may be disposed on more downstream side than the nip portion in the rotation direction of the fixing rotator such that the sheet is separated from the fixing rotator by the separation member.

The separation member includes a contact type and a non-contact type, wherein the contact-type separation member causes a separation claw to be in contact with the surface of the fixing rotator, and the non-contact-type separation member separates the sheet by using a thin metal separation plate disposed at a position distanced away from the surface of the fixing rotator. Color image forming apparatuses are more easily influenced than monochrome image forming apparatuses by a flaw generated on the surface of the fixing rotator and a potential difference generated on the surface of the fixing rotator. As a result, many color image forming apparatuses include a separation plate which is a non-contact-type member. In that case, it is necessary to maintain, with a high accuracy, a gap between the surface of the fixing rotator and a tip of the separation plate that is close to the fixing rotator.

In general, a color toner image is composed of overlaid toner images of different colors, and thus has a larger amount of toner carried on the sheet than a monochrome toner image. As a result, in color image forming apparatuses, a sheet is likely to stick to the surface of the fixing rotator by the fused toner. To prevent the sheet from sticking, the surface of the fixing rotator is often made of a fluorine material. For example, in the case where the fixing rotator is a fixing roller, the surface of the fixing roller is coated with a layer of pure fluororesin. In the case where the fixing rotator is a fixing belt, a PFA tube (fluororesin tube) is used for the surface of the belt.

In the fixing device as such, when a plurality of sheets having a relatively strong frictional force pass through the nip portion continuously in a low-temperature low-humidity environment, the surface of the fixing rotator is frictionally charged. In the charging series, fluorine is located on the most minus side, wherein the charging series indicate levels of charging that occur when different substances are frictioned. As a result, by the frictional charging, the surface of the fixing rotator is charged in minus. As the number of sheets continuously passing through the nip portion increases, the amount of charging on the surface of the fixing rotator increases. With the increase of the amount of charging, a local discharge may occur between the tip of the separation plate and the surface of the fixing rotator. In that case, the surface of the fixing rotator will have a part from which electricity has been removed by the local discharge, and a part where the charged state is maintained. When the part from which electricity has been removed approaches the nip portion as the fixing rotator rotates, a phenomenon called electrostatic scattering occurs in which toner that has not been fixed to the sheet is scattered.

As the countermeasure for the electrostatic scattering, there are known, for example, a method of forming the surface of the fixing roller from a material other than the pure fluorine, a method of removing electric charges from the separation plate, and a method of making the separation plate electrically floating. For example, as the method of forming the surface of the fixing roller from a material other than the pure fluorine, the fixing rotator is formed from an electrically conductive PFA tube mixed with an electrically conductive material such as carbon. This restricts electric charges from being charged on the surface of the fixing rotator. However, this method introduces another problem where toner and paper dust stick to the surface of the fixing rotator. This is because the electrically conductive PFA tube has less sheet separation performance than pure-fluorine-based PFA tube. As the method of removing electric charges from the separation plate, for example, a separation plate having a polished end portion may be used. In this method, a local discharge is generated frequently onto the separation plate from the surface of the fixing rotator so as to restrict the amount of charging on the surface of the fixing rotator. However, since it is difficult to control the location and the frequency of the local discharge occurrence, the method could not be the fundamental solution to the electrostatic scattering. As the method of making the separation plate electrically floating, for example, a discharge path in which electric charges flow may be interrupted. This makes it possible to restrict the local discharge from being generated, and restrict the electrostatic scattering. However, with the increase of the amount of charging on the surface of the fixing rotator and the rise of the potential, problems such as electromagnetic wave noise in the image forming apparatus and abnormality in the image fixed on the sheet may occur. In addition, the charging of the separation plate itself may cause the sheet to slide on the separation plate when being conveyed, leading to problems such as an image quality degradation and even a paper jam.

As a conventional technology dealing with the above-mentioned problem, there is known an image forming apparatus that restricts the electrostatic scattering by switching the fixing rotator and the pressure rotator between the grounding state and the floating state.

SUMMARY

A fixing device according to an aspect of the present disclosure includes a first rotator, a second rotator, a support mechanism, a displacement mechanism, a separation member, and an interlocking mechanism. The first rotator transmits heat to a sheet on which a toner image has been transferred. The second rotator forms a nip portion by making pressure-contact with the first rotator and applies pressure to the sheet passing through the nip portion. The support mechanism supports the first rotator and the second rotator in such a way as to be displaced between a pressure-contact attitude in which the first rotator and the second rotator make pressure-contact with each other and form the nip portion and a distanced attitude in which the first rotator and the second rotator are distanced away from each other and release the nip portion. The displacement mechanism transmits a driving force to any of the first rotator and the second rotator such that the first rotator and the second rotator are displaced in attitude between the pressure-contact attitude and the distanced attitude. The separation member has an electric conductivity, is extended toward the first rotator, includes a first end portion on a side of the first rotator, and separates the sheet that has passed through the nip portion from the first rotator by using the first end portion. The interlocking mechanism, in interlock with a displacement from the pressure-contact attitude to the distanced attitude by the displacement mechanism, displaces the first end portion in a first direction of going away from the first rotator, and causes the separation member to be in a first state where the separation member is conducted with a predetermined reference potential member having a reference potential so that a potential of the separation member becomes the reference potential, and discharge from the first rotator to the separation member is accelerated.

An image forming apparatus according to another aspect of the present disclosure includes the fixing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes the first embodiment and the second embodiment of the present disclusure with reference to the accompanying drawings. It should be noted that the following description includes examples of specific embodiments of the present disclosure and should not limit the technical scope of the disclosure.

First Embodiment

Image Forming Apparatus 10

Figure 1:
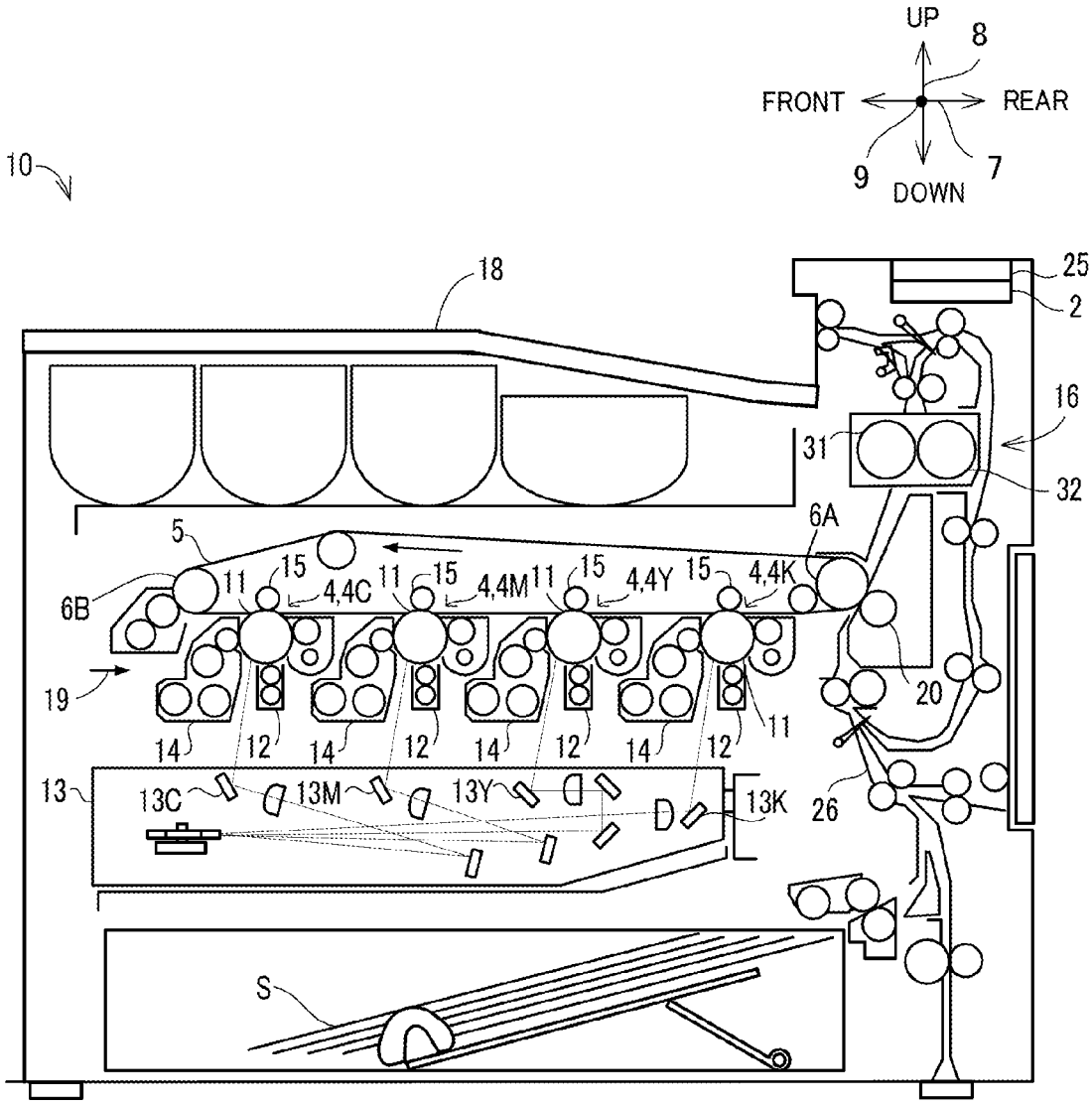
FIG. 1 is a diagram showing the configuration of an image forming apparatus according to the first embodiment of the present disclosure.

The following describes an outlined configuration of an image forming apparatus 10 according to the first embodiment of the present disclosure with reference to FIG. 1. It is noted that for the sake of explanation, the vertical direction in the installment state (the state shown in FIG. 1) where the image forming apparatus 10 is installed in a usable manner is defined as an up-down direction 8. In addition, a left-right direction 9 is defined on the supposition that the plane of FIG. 1 is the right surface in the above-mentioned installment state. Furthermore, a front-rear direction 7 is defined on the supposition that the left side of FIG. 1 is the front side and the right side of FIG. 1 is the rear side in the above-mentioned installment state.

As shown in FIG. 1, the image forming apparatus 10 is a so-called tandem color image forming apparatus, and includes a control portion 2, a plurality of image forming units 4, an intermediate transfer belt 5, a driving roller 6A, a driven roller 6B, an optical scanning device 13, a secondary transfer roller 20, a fixing device 16, a sheet tray 18, an operation display portion 25, and a conveyance path 26. The image forming apparatus 10 forms a monochrome image or a color image on a sheet S based on input image data. It is noted that the sheet S is an example of the sheet of the present disclosure and is a sheet-like material such as a sheet of paper, a sheet of coated paper, a postcard, an envelope, or an OHP sheet. In addition, other examples of the image forming apparatus of the present disclosure include a facsimile, a copier, and a multifunction peripheral.

Image forming units are arranged in order of an image forming unit 4K for black, an image forming unit 4Y for yellow, an image forming unit 4M for magenta, and an image forming unit 4C for cyan in an alignment along the running direction (the direction indicated by the arrow 19) of the intermediate transfer belt 5. The image forming units 4 (4K, 4Y, 4M and 4C) each include a photoconductor drum 11, a charging device 12, a developing device 14, and a primary transfer roller 15.

Fixing Device 16

Figure 2A:
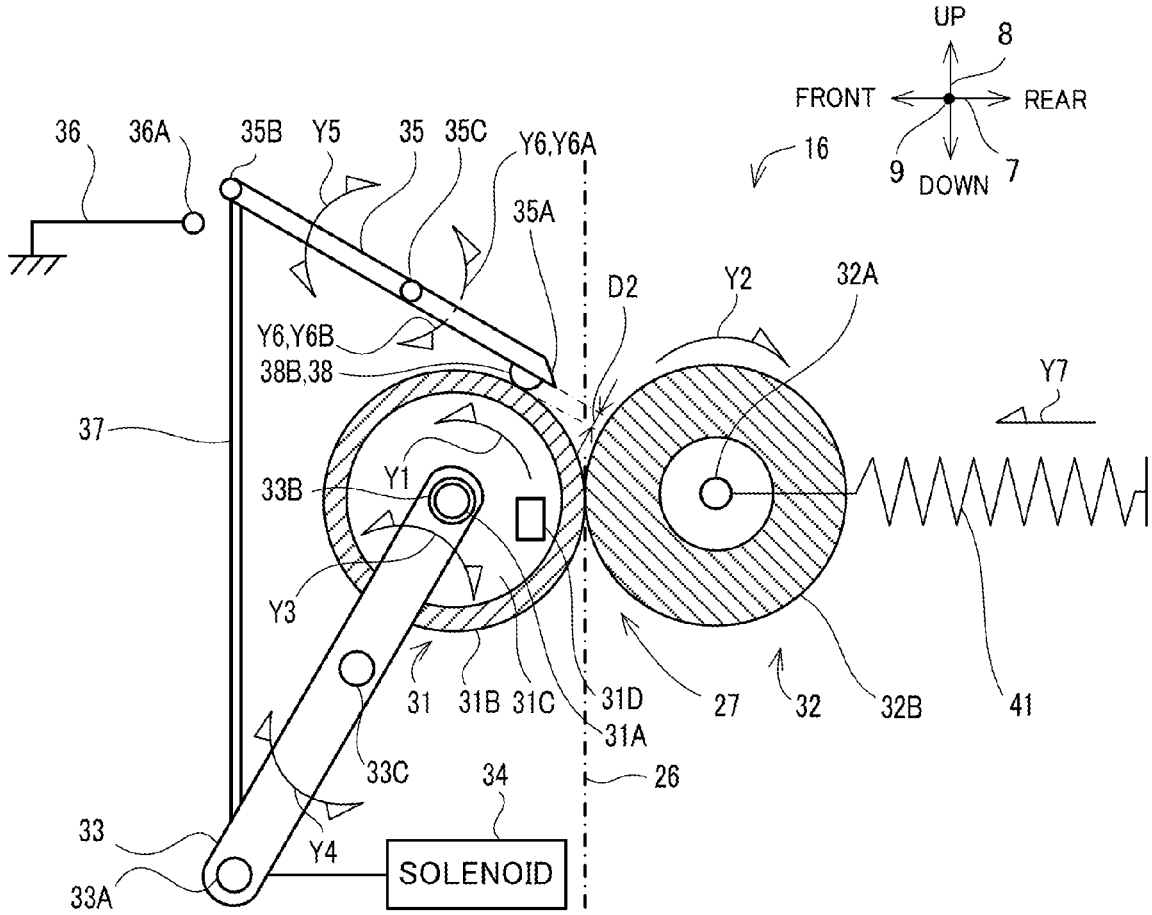
FIG. 2A and FIG. 2B are diagrams showing the configuration of a fixing device according to the first embodiment of the present disclosure.
Figure 2B:
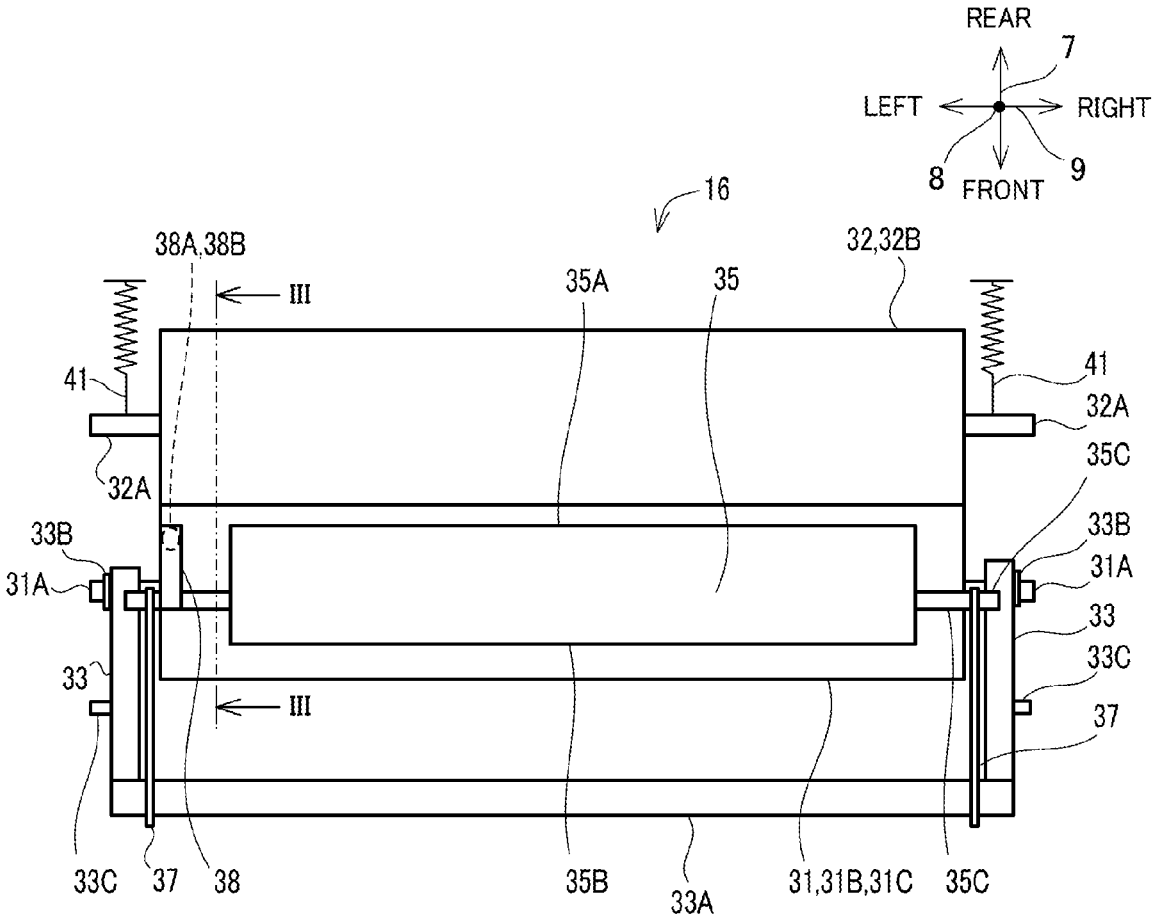

FIG. 2A is a side view of the fixing device 16. FIG. 2B is a top view of the fixing device 16. As shown in FIG. 2A and FIG. 2B, the fixing device 16 includes a heating roller 31 (an example of the first rotator of the present disclosure), a pressure roller 32 (an example of the second rotator of the present disclosure), a pair of arms 33, a solenoid 34 (an example of the displacement mechanism of the present disclosure), a separation plate 35 (an example of the separation member of the present disclosure), a pair of interlocking arms 37 (an example of the interlocking mechanism of the present disclosure), a ground wire 36 (an example of the reference potential portion of the present disclosure), a positioning member 38 (an example of the abutting portion of the present disclosure), and biasing springs 41. It is noted that the arms 33 and the biasing springs 41 are an example of the support mechanism of the present disclosure.

The heating roller 31 tramsmits heat to the sheet S on which a toner image has been transferred. The heating roller 31 includes a roller body 31C having a cylindrical shape. During fixing, a roller surface 31B of the roller body 31C contacts a development surface (a surface to which the toner image has been adhered) of the sheet S. The roller body 31C is made of a material having a high thermal conductivity, for example, a metal such as aluminum. The surface of the roller body 31C is coated with a fluororesin layer to facilitate toner separation. Opposite end portions of the roller body 31C are respectively provided with rotation shafts 31A which are rotationally supported by roller support portions 33B of the arms 33 respectively. The rotation shafts 31A of the heating roller 31 are connected with a motor that is driven and controlled by the control portion 2 (see FIG. 1). When the motor is rotationally driven, the rotational driving force is transmitted to the heating roller 31, and the heating roller 31 rotates counterclockwise (arrow Y1) in FIG. 2A.

The heating roller 31 includes a heater 31D. The heater 31D is disposed inside the roller body 31C. The heater 31D is composed of, for example, a halogen lamp. The heater 31D extends inside the roller body 31C in the axis direction thereof, and heats the whole region of the roller body 31C in the axis direction from inside. It is noted that the heater 31D is a mere example of a heating device and may be replaced with another heating device such as an induction heating device that heats the heating roller 31 itself by the action of the magnetic flux.

The pressure roller 32 is disposed to face, and in parallel with, the heating roller 31. In FIG. 2A, the pressure roller 32 is on the right side of the heating roller 31. The pressure roller 32 is supported so as to be rotatable in a pressure-contact attitude where it is made pressure-contact with the surface of the heating roller 31 by a predetermined pressure. Specifically, a rotation shaft 32A is provided at the center of the pressure roller 32, and the rotation shaft 32A is rotationally supported by the biasing springs 41. This allows the pressure roller 32 to rotate. The pressure roller 32 includes an elastic portion 32B having a cylindrical shape and made of an elastic material such as silicon or porous rubber. The pressure roller 32 is made pressure-contact with the heating roller 31 by the biasing springs 41 (arrow Y7). With this configuration, when the elastic portion 32B is made pressure-contact with the roller body 31C, the elastic portion 32B is elastically deformed to a dented curve such that a nip portion 27 is formed between the heating roller 31 and the pressure roller 32. In addition, the pressure roller 32 follows the rotation of the heating roller 31 by the contact friction at the nip portion 27, and rotates clockwise (arrow Y2) in FIG. 2A. Due to the rotation of the heating roller 31 and the pressure roller 32, the sheet S is conveyed so as to pass through the nip portion 27 from below to above. The pressure roller 32 applies pressure to the sheet S when it passes through the nip portion 27.

The pair of arms 33 rotationally support the heating roller 31 at the opposite ends of the heating roller 31 in the left-right direction 9 such that the heating roller 31 can be positionally displaced. Each arm 33 includes a roller support portion 33B and a pivoting shaft 33C. The roller support portion 33B is provided at an end portion of the arm 33 and rotationally supports the rotation shaft 31A of the heating roller 31. The pivoting shaft 33C is supported by the housing of the fixing device 16, and becomes a pivoting shaft of the arm 33 when the arm 33 is pivoted. In addition, a transmitted portion 33A that extends in the left-right direction 9 is provided to connect the other end portions of the arms 33 with each other. The transmitted portion 33A receives a driving force transmitted from the solenoid 34. This enables the arms 33 to receive the driving force transmitted from the solenoid 34 (arrow Y4) and displace the heating roller 31 with respect to the pressure roller 32, the arms 33 supporting the heating roller 31 so as to be displaced between the pressure-contact attitude and a distanced attitude (arrow Y3). In the pressure-contact attitude, the heating roller 31 and the pressure roller 32 are made pressure-contact with each other and the nip portion 27 is formed therebetween. In the distanced attitude, the heating roller 31 and the pressure roller 32 are distanced away from each other and the nip portion 27 is released. The displacement between the pressure-contact attitude and the distanced attitude by the arms 33 is described in detail below.

Separation Plate 351

The separation plate 35 is disposed more on the downstream side in the sheet S conveyance direction than the nip portion 27, to face the heating roller 31. The separation plate 35 is configured to separate the sheet S having passed through the nip portion 27 from the heating roller 31, to prevent the sheet S from being stuck and wound around the heating roller 31. The separation plate 35 is a plate-like member composed of a first end portion 35A (an example of the first end portion of the present disclosure); a second end portion 35B (an example of the second end portion of the present disclosure); and a rotation shaft 35C (an example of the rotation shaft of the present disclosure), and is long in axis direction of the heating roller 31 (left-right direction 9). The rotation shaft 35C extends in a direction parallel to the rotation shafts 31A of the heating roller 31, and rotationally supports the separation plate 35. The first end portion 35A extends from the rotation shaft 35C toward the heating roller 31 and its tip has a sharpened shape. Specifically, the first end portion 35A extends from the rotation shaft 35C in a direction against the rotation direction (arrow Y1) of the heating roller 31. The direction in which the first end portion 35A extends is approximately parallel to the direction of a tangent of the heating roller 31, or intersects with the direction of the tangent at a predetermined angle. In the pressure-contact attitude, the sheet S having passed through the nip portion 27 is separated from the heating roller 31 by the first end portion 35A. The second end portion 35B extends from the rotation shaft 35C in an opposite direction to the first end portion 35A. In the pressure-contact attitude, the second end portion 35B is distanced away from the ground wire 36, and in the distanced attitude, the second end portion 35B is in contact with the ground wire 36. The ground wire 36 is connected with a predetermined reference potential member having a reference potential. When the separation plate 35 is connected with the ground wire 36, the separation plate 35 is conducted therewith and its potential becomes the reference potential. It is noted that the reference potential is not limited to the ground potential. The rotation of the separation plate 35 is described below together with the pivoting by the arms 33.

In the pressure-contact attitude, the first end portion 35A of the separation plate 35 is distanced away from the roller surface 31B of the heating roller 31 by a second distance D2, and is not in contact with the roller surface 31B. It is noted that although a contact portion 38B of the positioning member 38 appears to be integrally formed with the separation plate 35 in FIG. 2A, as shown in FIG. 2B, actually, the positioning member 38 is disposed on the left side of the separation plate 35, with a certain distance therebetween. As described below, in the pressure-contact attitude, the contact portion 38B contacts the roller surface 31B, and the first end portion 35A is not in contact with the roller surface 31B. The leading edge of the sheet S that has passed through the nip portion 27 floats above the roller surface 31B of the heating roller 31. This is because toner does not adhere to the leading edge and thus sticking due to the fused toner does not occur, and a bending repulsive force of the sheet S is likely to occur. At the timing when the sheet S comes out of the nip portion 27, the separation plate 35 is positioned between the roller surface 31B of the roller body 31C and the leading edge of the sheet S. As a result, the separation plate 35 can separate the sheet S from the heating roller 31.

Figure 3:
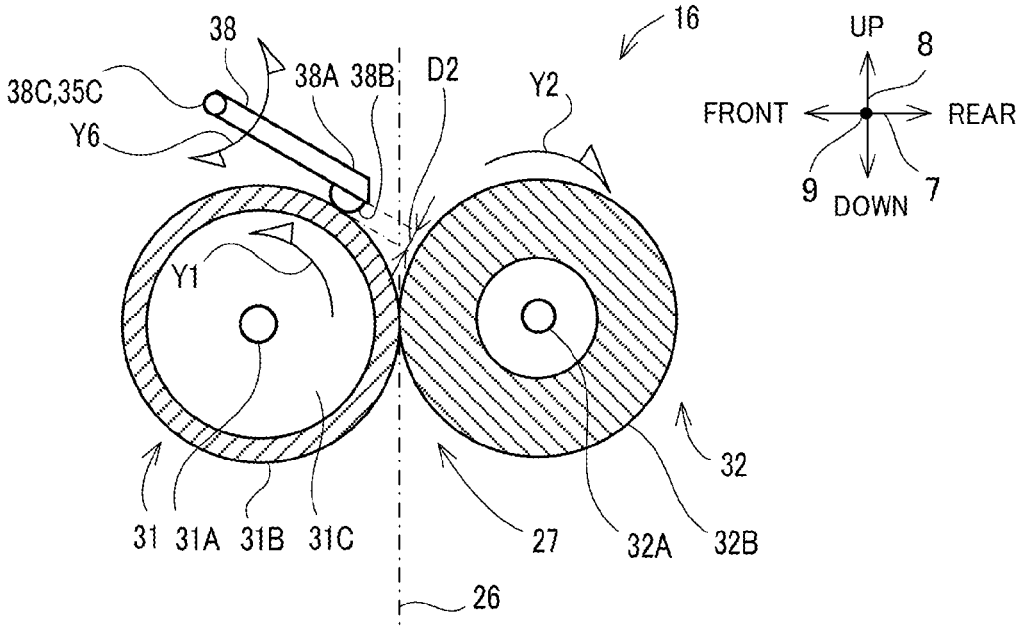
FIG. 3 is a diagram showing a positioning member of the fixing device according to the first embodiment of the present disclosure.

As shown in FIG. 2B, the positioning member 38 is provided outside the area of the heating roller 31 in which the sheet S passes through the nip portion 27. FIG. 3 is a cross sectional view taken along the line III-III of FIG. 2B. The positioning member 38 extends from the rotation shaft 35C in parallel to and by the same length as the first end portion 35A. The positioning member 38 includes the contact portion 38B (see FIG. 3) that is made of an insulating material. The contact portion 38B is disposed at an extension end 38A (see FIG. 3) of the positioning member 38 that faces the heating roller 31. As shown in FIG. 2A and FIG. 3, the thickness of the contact portion 38B is the same as the second distance D2 that is shorter than a first distance D1 described below. In the pressure-contact attitude, in the state where the separation plate 35 is close to the heating roller 31, the contact portion 38B of the positioning member 38 is caused to abut on the heating roller 31. As a result, a gap for separating the sheet S is formed between the first end portion 35A and the roller surface 31B of the heating roller 31, wherein a distance of the gap therebetween is the same as the second distance D2.

The separation plate 35 is made of an electrically conductive material such as a metal or a conductive resin. In the fixing device 16 as such, when a plurality of sheets S having a strong frictional force pass through the nip portion 27 continuously in a low-temperature low-humidity environment, the surface of the roller surface 31B of the heating roller 31 is frictionally charged. As the number of sheets S continuously passing through the nip portion 27 increases, the amount of charging on the surface of the roller surface 31B increases. If the second end portion 35B were in contact with the ground wire 36, the amount of charging would increase, and a local discharge might occur between the first end portion 35A of the separation plate 35 that is in the non-contact state and the roller surface 31B of the heating roller 31. In that case, the surface of the roller surface 31B of the heating roller 31 would have a part from which electricity has been removed by the local discharge, and a part where the charged state is maintained. Then when the part from which electricity has been removed approaches the nip portion 27 as the heating roller 31 rotates, a phenomenon in which toner that has not adhered to the sheet S is scattered occurs. Here, if the second end portion 35B were distanced away from the ground wire 36, the local discharge between the heating roller 31 and the separation plate 35 would be restricted. However, since the amount of charging on the surface of the roller surface 31B increases and the potential of the surface increases, problems such as electromagnetic wave noise in the image forming apparatus 10 and abnormality in the image fixed on the sheet S may occur. In addition, the charging of the separation plate 35 itself may cause the sheet S to stick thereto, leading to a problem such as a paper jam. On the other hand, the fixing device 16 of the first embodiment is configured such that, in the pressure-contact attitude, the second end portion 35B of the separation plate 35 is distanced away from a terminal 36A of the ground wire 36, with the separation plate 35 being in the floating potential state, and thus the local discharge is restricted. Here, the floating potential refers to an independent potential which is generated in a member when the member is not in electrical contact with another member such as the ground wire 36. Furthermore, when an image formation is completed, the second end portion 35B of the separation plate 35 is connected with the terminal 36A of the ground wire 36. This allows a local discharge to be generated between the first end portion 35A of the separation plate 35 that is in the non-contact state and the roller surface 31B, and electric charges on the charged roller surface 31B are removed. In this way, the fixing device 16 of the first embodiment can remove electric charges from the heating roller 31 that is charged during a non-image-formation period, while restricting generation of a local discharge between the separation plate 35 and the heating roller 31 during an image formation period. The following describes a mechanism for displacing the attitude of the separation plate 35 in interlock with the positional displacement of the heating roller 31.

Interlocking Between Positional Displacement of Heating Roller 31 and Attitudinal Displacement of Separation Plate 35

As shown in FIG. 2A, the solenoid 34 transmits a driving force to the transmitted portion 33A such that the transmitted portion 33A, together with the arms 33, pivots around the pivoting shaft 33C (arrow Y4). This allows the roller support portion 33B, which supports the rotation shafts 31A of the heating roller 31, to be moved toward and away from the pressure roller 32 (arrow Y3). In this way, the solenoid 34 transmits a driving force to the heating roller 31 such that the heating roller 31 and the pressure roller 32 are displaced in attitude between the pressure-contact attitude and the distanced attitude.

One end portion of each interlocking arm 37 is connected with the transmitted portion 33A, and the other is connected with the second end portion 35B of the separation plate 35. The interlocking arms 37 transmit the driving force of the solenoid 34 to the separation plate 35 so as to interlock the positional displacement of the heating roller 31 with the attitudinal displacement of the separation plate 35. When the transmitted portion 33A is pivoted by the solenoid 34 (arrow Y4), the second end portion 35B of the separation plate 35 is also pivoted (arrow Y5), and the first end portion 35A is pivoted around the rotation shaft 35C (arrow Y6). The interlocking arms 37 cause the separation plate 35 to rotate around the rotation shaft 35C between the first attitude and the second attitude. In the first attitude, the interlocking arms 37 cause the separation plate 35 to be in a first state where the first end portion 35A is distanced away from the heating roller 31 by the first distance D1, the second end portion 35B is connected with the ground wire 36, and the separation plate 35 is conducted with the ground wire 36. More specifically, in interlock with the displacement from the pressure-contact attitude to the distanced attitude by the solenoid 34, the interlocking arms 37 cause the separation plate 35 to rotate from the second attitude to the first attitude. The interlocking arms 37 cause the first end portion 35A to be displaced in the first direction (see arrow Y6A of FIG. 2A) of going away from the heating roller 31. In addition, the interlocking arms 37 cause the second end portion 35B to be conducted with the ground wire 36 so that the potential of the separation plate 35 becomes the reference potential. In the first attitude, the potential difference between the heating roller 31 and the separation plate 35 increases, and therefore the discharge from the heating roller 31 to the separation plate 35 is accelerated. On the other hand, in the second attitude, the interlocking arms 37 cause the separation plate 35 to be in a second state where the first end portion 35A is distanced away from the heating roller 31 by the second distance D2, the second end portion 35B is not in contact with the ground wire 36, and the separation plate 35 is not conducted with the ground wire 36. More specifically, in interlock with the displacement from the distanced attitude to the pressure-contact attitude by the solenoid 34, the interlocking arms 37 cause the separation plate 35 to rotate from the first attitude to the second attitude. The interlocking arms 37 cause the first end portion 35A to be displaced in the second direction (see arrow Y6B of FIG. 2A)

of approaching the heating roller 31. In addition, the interlocking arms 37 cause the second end portion 35B not to be conducted with the ground wire 36 so that the potential of the separation plate 35 changes from the reference potential to the floating potential. In the second attitude, the potential difference between the heating roller 31 and the separation plate 35 decreases, and therefore the discharge from the heating roller 31 to the separation plate 35 is restricted.

Figure 4:
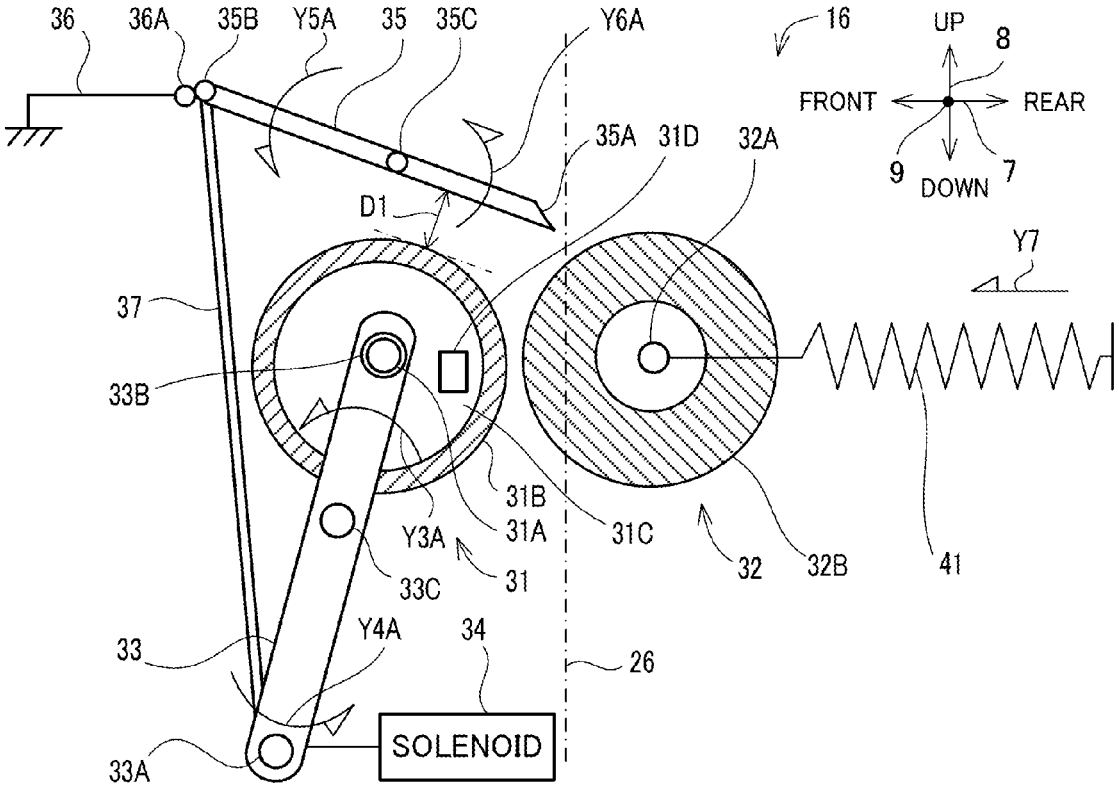
FIG. 4 is a diagram showing a pressure-contact attitude and a distanced attitude of the fixing device according to the first embodiment of the present disclosure.

As shown in FIG. 4, when the solenoid 34 pulls the transmitted portion 33A rearward in the front-rear direction 7 (arrow Y4A), the attitude of the heating roller 31 changes from the pressure-contact attitude to the distanced attitude (arrow Y3A). The interlocking arms 37 cause the second end portion 35B to pivot toward the terminal 36A of the ground wire 36 (arrow Y5A) and causes the first end portion 35A to pivot in the first direction of going away from the heating roller 31 (arrow Y6A). In other words, the first end portion 35A is displaced by the interlocking arms 37 to the first attitude where it is distanced away from the heating roller 31 by the first distance D1. Together with this, by the interlocking arms 37, the second end portion 35B is connected and conducted with the terminal 36A of the ground wire 36. In this case, the whole separation plate 35 is grounded and the potential of the separation plate 35 becomes the reference potential. As a result, when the heating roller 31 has been charged and the potential difference is large, the separation plate 35 is in the first attitude by which the discharge between the heating roller 31 and the separation plate 35 is accelerated.

On the other hand, as shown in FIG. 2A, when the solenoid 34 pushes the transmitted portion 33A frontward in the front-rear direction 7, the attitude of the heating roller 31 changes from the distanced attitude to the pressure-contact attitude. The interlocking arms 37 cause the second end portion 35B to pivot in a direction of going away from the terminal 36A of the ground wire 36 and causes the first end portion 35A to pivot in the second direction of approaching the heating roller 31 (arrow Y6B). In other words, the first end portion 35A is displaced by the interlocking arms 37 to the second attitude where it is distanced away from the heating roller 31 by the second distance D2. In the second attitude, if the sheet S passes through the nip portion 27, the sheet S is separated from the heating roller 31 by the first end portion 35A. In addition, by the interlocking arms 37, the second end portion 35B is distanced away from, and is not conducted with the terminal 36A of the ground wire 36. In this case, the potential of the whole conductive bseparation plate 35 becomes the floating potential. As a result, when the heating roller 31 is charged, the potential state of the separation plate 35 is interlocked with it. Therefore the separation plate 35 takes the second attitude by which the discharge between the heating roller 31 and the separation plate 35 is restricted.

Furthermore, as shown in FIG. 3, the interlocking arms 37 displace the attitude of the positioning member 38, as well as the attitude of the separation plate 35. In response to the change of attitude by the solenoid 34 from the pressure-contact attitude to the distanced attitude, the interlocking arms 37 cause the contact portion 38B of the positioning member 38 to be distanced away from the heating roller 31. In addition, in response to the change of attitude by the solenoid 34 from the distanced attitude to the pressure-contact attitude, the interlocking arms 37 causes the contact portion 38B of the positioning member 38 to abut on the heating roller 31. The contact portion 38B is disposed at the extension end 38A of the positioning member 38 that faces the heating roller 31. As a result, in the pressure-contact attitude, the solenoid 34 keeps the distance of the gap between the separation plate 35 and the surface of the heating roller 31 to be the second distance D2 that is the same as the thickness of the contact portion 38B.

As described above, the fixing device 16 includes the interlocking arms 37 and the separation plate 35, wherein the interlocking arms 37 displace the attitude of the separation plate 35 in interlock with the positional displacement of the heating roller 31, and the separation plate 35 changes its attitude. With such a simple configuration, the fixing device 16 can restrict the discharge between the heating roller 31 and the separation plate 35 during an image formation period, and restrict the electrostatic scattering by discharging electric charges that have been charged on the heating roller 31 during a non-image-formation period.

Furthermore, compared to a conventional image forming apparatus that restricts the electrostatic scattering by switching the fixing rotator and the pressure rotator between the grounding state and the floating state, the above-described configuration of the fixing device 16 enables the electrostatic scattering to be restricted by a simple configuration.

Second Embodiment

According to the above-described first embodiment, the attitude of the separation plate 35 is displaced in correspondence with the positional displacement of the heating roller 31. However, the present disclosure is not limited to the configuration. For example, it is possible to have a configuration where, in the pressure-contact attitude, the discharge from the heating roller 31 is restricted, and in the distanced attitude, the discharge of electric charges from the heating roller 31 is accelerated. In the second embodiment, the separation plate 35 includes an electricity removing sheet 39 and a cover 40, and the attitude of the cover 40 is displaced by the interlocking arms 37. Here, the second embodiment differs from the first embodiment in that the separation plate 35 includes the electricity removing sheet 39 and the cover 40, and the attitude of the cover 40 is displaced by the interlocking arms 37 based on the change between the pressure-contact attitude and the distanced attitude. Otherwise, the second embodiment has configurations and the like that are common to the first embodiment. As a result, in the following description of the present embodiment, only the difference from the first embodiment is described, and description of common configurations is omitted.

Separation Plate 35

Figure 5A:
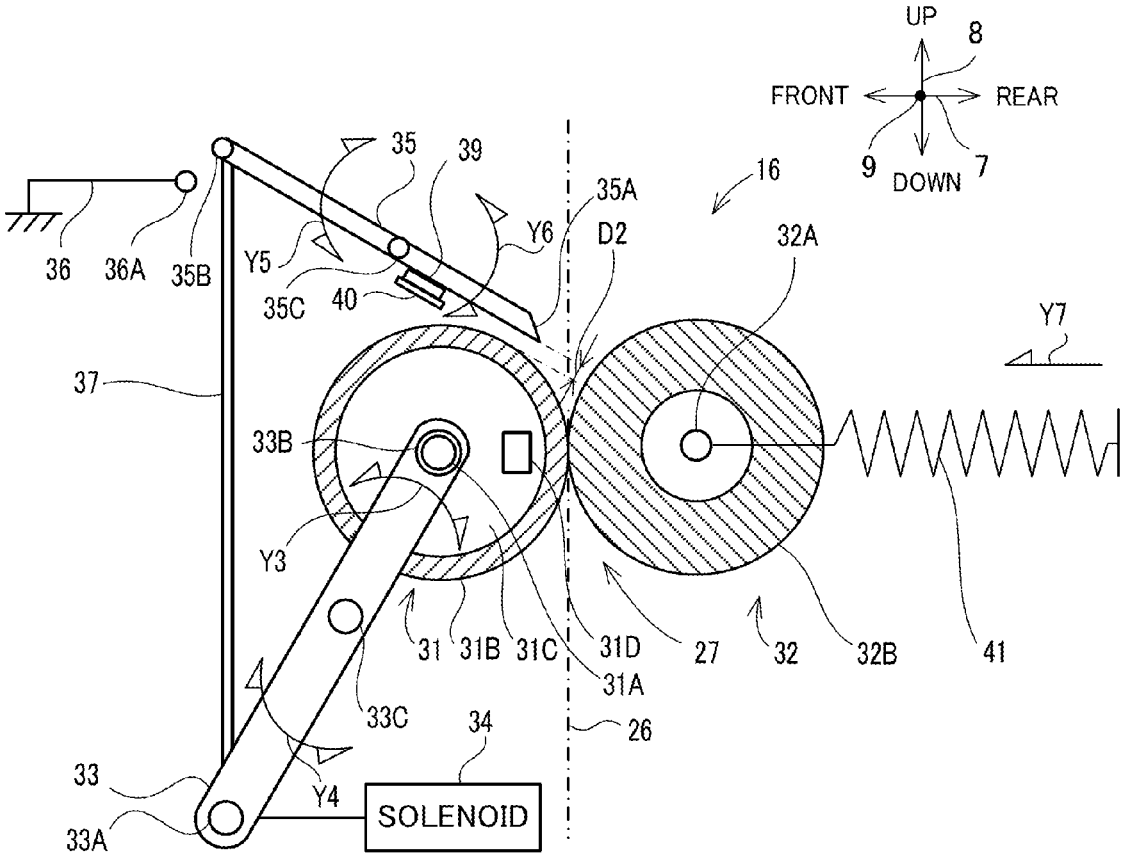
FIG. 5A and FIG. 5B are diagrams showing the pressure-contact attitude and the distanced attitude of the fixing device according to the second embodiment of the present disclosure.
Figure 5B:
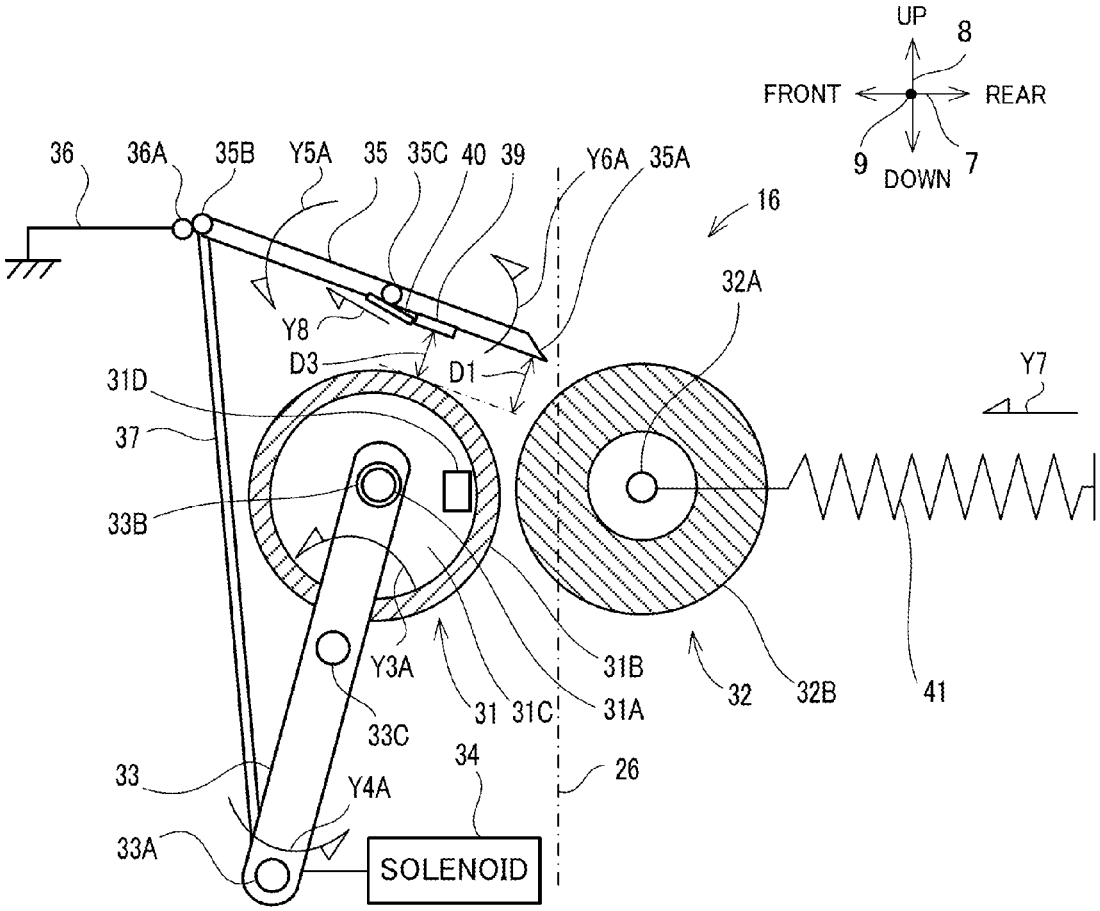

FIG. 5A shows the fixing device 16 in the pressure-contact attitude. FIG. 5B shows the fixing device 16 in the distanced attitude. The separation plate 35 includes the electricity removing sheet 39 between the rotation shaft 35C and a tip of the first end portion 35A that faces the heating roller 31. The electricity removing sheet 39 is a sheet formed by, for example, a reaction of a copolymer of polypyrrole with a surface of a base fabric that is formed from polyester ultrafine fiber and polyamide. The electricity removing sheet 39 is a highly conductive member whose electrical conductivity is higher than the separation plate 35.

As shown in FIG. 5A, in the pressure-contact attitude, when the separation plate 35 is in the second attitude, the electricity removing sheet 39 is more distanced away from the surface of the heating roller 31 than the first end portion 35A. On the other hand, as shown in FIG. 5B, when the separation plate 35 is in the first attitude, the electricity removing sheet 39 is closer to the heating roller 31 than the first end portion 35A. In other words, a third distance D3 is shorter than the first distance D1, wherein the third distance D3 is a distance between the electricity removing sheet 39 and the surface of the heating roller 31, and the first distance D1 is a distance between the first end portion 35A and the surface of the heating roller 31. Since the electricity removing sheet 39 has higher electrical conductivity than the separation plate 35, a discharge is likely to occur between the electricity removing sheet 39 and the surface of the heating roller 31. In addition, when the separation plate 35 is in the second attitude, the electricity removing sheet 39 is more distanced away from the heating roller 31 than the first end portion 35A. In other words, the third distance D3 is longer than the first distance D1, wherein the third distance D3 is a distance between the electricity removing sheet 39 and the surface of the heating roller 31, and the first distance D1 is a distance between the first end portion 35A and the surface of the heating roller 31. Since the separation plate 35 has a lower electrical conductivity than the electricity removing sheet 39, the discharge between the first end portion 35A and the surface of the heating roller 31 is restricted.

The cover 40 is an insulating member configured to cover the electricity removing sheet 39, and restricts the discharge between the electricity removing sheet 39 and the surface of the heating roller 31 by covering the electricity removing sheet 39.

The interlocking arms 37, when displacing the attitude of the separation plate 35, displace the attitude of the cover 40 as well. In the first attitude, the interlocking arms 37 displace the cover 40 to an attitude by which the electricity removing sheet 39 is exposed. This accelerates the discharge between the electricity removing sheet 39 and the surface of the heating roller 31. In other words, in interlock with a change from the pressure-contact attitude to the distanced attitude made by the solenoid 34, the interlocking arms 37 displace the cover 40 from an attitude where the electricity removing sheet 39 is covered to an attitude where the electricity removing sheet 39 is exposed (arrow Y8).

As described above, the fixing device 16 can accelerate the discharge in the distanced attitude with a configuration where the electricity removing sheet 39 is provided on the separation plate 35 whose attitude is displaced in interlock with the positional displacement of the heating roller 31. Furthermore, the fixing device 16 can restrict the discharge in the pressure-contact attitude with a configuration where the cover 40 is provided in such a way as to cover or expose the electricity removing sheet 39 in interlock with the attitudinal displacement of the separation plate 35. In this way, the fixing device 16 of the second embodiment can restrict the electrostatic scattering by a simple configuration.

Modifications of Embodiments

In the first embodiment and the second embodiment, description is given of the separation plate 35 of the non-contact system where the separation plate 35 is distanced away from the heating roller 31. However, the present disclosure is not limited to this configuration. For example, instead of the separation plate 35, a separation claw that is displaceable between the first attitude and the second attitude may be used. In that case, in the second attitude, the separation claw may be in contact with the heating roller 31. As another modification, the separation plate 35 may not include the second end portion 35B. For example, in the first attitude, a first surface of the separation plate 35 that is on the opposite side from the heating roller 31 may be in contact with the terminal 36A of the ground wire 36, and in the second attitude, the first surface of the separation plate 35 may be distanced away from the terminal 36A of the ground wire 36. In the first embodiment and the second embodiment, description is given of the separation plate 35 that is displaced between the first attitude and the second attitude by rotating around the rotation shaft 35C. However, the present disclosure is not limited to this configuration. For example, the whole of the separation plate 35 may be moved toward and away from the heating roller 31, or the separation plate 35 may be deformed in shape in such a way as to move toward and away from the heating roller 31. In the case of the configuration where the whole of the separation plate 35 is moved, the whole of the separation plate 35 is distanced away from the heating roller 31 and connected with the ground wire 36 so as to be in the first state, and the whole of the separation plate 35 is approached to the heating roller 31 so as to be able to separate the sheet S and is disconnected from the ground wire 36, so as to be in the second state. In the case of the configuration where the separation plate 35 is deformed in shape, the separation plate 35 is bent so as to be in the first state where it is distanced away from the heating roller 31 and connected with the ground wire 36, and the separation plate 35 is made straight so as to be in the second state where it approaches the heating roller 31 so as to be able to separate the sheet S and is disconnected from the ground wire 36. In this way, the separation plate 35 may be configured to change between the first state and the second state, not displaced in attitude.

In the first embodiment and the second embodiment, the arms 33 and the biasing springs 41 constitute the support mechanism, and the solenoid 34 constitutes the displacement mechanism. However, the present disclosure is not limited to this configuration. For example, the arms 33 and the biasing springs 41 may support the pressure roller 32, and the solenoid 34 may transmit the driving force to the pressure roller 32 in such a way as to be displaced between the pressure-contact attitude and the distanced attitude. In the embodiments, description is given of the case where the displacement mechanism is the solenoid 34. However, not limited to this, the displacement mechanism may be, for example, a drive motor. In addition, the interlocking mechanism is not limited to the interlocking arms 37. For example, the interlocking mechanism may be a transmission member such as a gear and a rotation shaft, or an electric motor that moves in interlock with the solenoid 34.

In the first embodiment and the second embodiment, the second end portion 35B is connected with the terminal 36A so that the potential of the separation plate 35 becomes the reference potential, and the second end portion 35B is distanced away from the terminal 36A so that the potential of the separation plate 35 becomes the floating potential. However, the method for switching between the reference potential state and the floating potential state is not limited to that example. For example, a switch may be used to switch between the reference potential state and the floating potential state. In addition, not limited to the ground wire 36, a grounding member such as a grounding plate may be used, for example.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a first rotator configured to transmit heat to a sheet on which a toner image has been transferred;

a second rotator configured to form a nip portion by making pressure-contact with the first rotator and apply pressure to the sheet passing through the nip portion;

a support mechanism configured to support the first rotator and the second rotator in such a way as to be displaced between a pressure-contact attitude in which the first rotator and the second rotator make pressure-contact with each other and form the nip portion and a distanced attitude in which the first rotator and the second rotator are distanced away from each other and release the nip portion;

a displacement mechanism configured to transmit a driving force to any of the first rotator and the second rotator such that the first rotator and the second rotator are displaced in attitude between the pressure-contact attitude and the distanced attitude;

a separation member having an electric conductivity, extended toward the first rotator, including a first end portion on a side of the first rotator, and configured to separate the sheet that has passed through the nip portion from the first rotator by using the first end portion; and an interlocking mechanism configured to, in interlock with a displacement from the pressure-contact attitude to the distanced attitude by the displacement mechanism, displace the first end portion in a first direction of going away from the first rotator, and cause the separation member to be in a first state where the separation member is conducted with a predetermined reference potential member having a reference potential so that a potential of the separation member becomes the reference potential, and discharge from the first rotator to the separation member is accelerated.

2. The fixing device according to claim 1, wherein when the first rotator and the second rotator are in the pressure-contact attitude, the separation member separates the sheet in a state where the first end portion is not in contact with the first rotator, and the interlocking mechanism, in interlock with a displacement from the distanced attitude to the pressure-contact attitude by the displacement mechanism, displaces the first end portion in a second direction of approaching the first rotator, and causes the separation member to be in a second state where the separation member is not conducted with the reference potential member so that the potential of the separation member changes from the reference potential to a floating potential, and the discharge from the first rotator to the separation member is restricted.

3. The fixing device according to claim 2, wherein the separation member is supported in such a way as to be rotatable between a first attitude and a second attitude around a predetermined rotation shaft, and when the separation member is in the first attitude, the separation member is in the first state where the separation member is conducted with the reference potential member, and when the separation member is in the second attitude, the separation member is in the second state where the separation member is not conducted with the reference potential member, and the interlocking mechanism, in interlock with the displacement from the pressure-contact attitude to the distanced attitude by the displacement mechanism, causes the separation member to rotate from the second attitude to the first attitude.

4. The fixing device according to claim 3, wherein the separation member further includes a second end portion which extends from the rotation shaft in an opposite direction to the first end portion, and in the first attitude, the second end portion is in contact with the reference potential portion, and in the second attitude, the second end portion is not in contact with the reference potential portion.

5. The fixing device according to claim 3, wherein the separation member further includes a highly conductive member on a surface thereof that faces the first rotator, the highly conductive member being higher in electrical conductivity than the separation member, and the highly conductive member is disposed such that when the separation member is in the first attitude, the highly conductive member is closer to the first rotator than the first end portion, and when the separation member is in the second attitude, the highly conductive member is more distanced away from the first rotator than the first end portion.

6. The fixing device according to claim 5, wherein the separation member further includes an insulating cover configured to cover the highly conductive member, and in the second attitude, the interlocking mechanism displaces the cover to an attitude of covering the highly conductive member, and in the first attitude, the interlocking mechanism displaces the cover to an attitude by which the highly conductive member is exposed.

7. The fixing device according to claim 2 further comprising an abutting portion formed from an insulating member and provided outside an area in which the sheet passes through the nip portion, the abutting portion configured to abut on the first rotator in a state where the separation member is in the second state by the interlocking mechanism, and form a gap for separating the sheet between the first end portion and the first rotator, and the interlocking mechanism, in interlock with the displacement from the pressure-contact attitude to the distanced attitude by the displacement mechanism, causes the abutting portion to be distanced away from the first rotator.

8. An image forming apparatus comprising the fixing device according to claim 1.

* * * * *